US007407129B2

(12) United States Patent
Robitaille et al.

(10) Patent No.: US 7,407,129 B2
(45) Date of Patent: Aug. 5, 2008

(54) TAPE DISPENSER/PACKAGE ASSEMBLY

(76) Inventors: Martin Robitaille, 4765, St-Félix, St-Augustin-de-Desmaures, Québec (CA); Steve Gagnon, 436, 1 Iième rue, Quebec (CA) G1J2N2

( * ) Notice: Subject to any disclaimer, the term of this patent is extended or adjusted under 35 U.S.C. 154(b) by 415 days.

(21) Appl. No.: 11/109,815

(22) Filed: Apr. 20, 2005

(65) Prior Publication Data

US 2005/0242225 A1 Nov. 3, 2005

(51) Int. Cl.
*B65H 23/06* (2006.01)
*B65H 18/02* (2006.01)

(52) U.S. Cl. ..... 242/422.4; 242/423; 242/594.4; 242/594.6

(58) Field of Classification Search ..... 242/160.1, 242/160.2, 422.4, 422.5, 422.6, 422.8, 423, 242/423.1, 423.2, 594.3, 594.4, 594.5, 594.6, 242/550

See application file for complete search history.

(56) References Cited

U.S. PATENT DOCUMENTS

| | | | | |
|---|---|---|---|---|
| 4,372,472 | A | 2/1983 | Herrmann | |
| 4,453,634 | A | 6/1984 | Blumenthal | |
| 4,676,446 | A | 6/1987 | Ciocarelli | |
| 4,917,327 | A | 4/1990 | Asbury, Jr. | |
| 4,998,655 | A | 3/1991 | Huang | |
| 5,029,768 | A | 7/1991 | Asbury, Jr. | |
| 5,071,051 | A | 12/1991 | Corbo | |
| 5,193,680 | A * | 3/1993 | Schumann et al. | 242/423.1 |
| 5,228,821 | A | 7/1993 | Gleffe | |
| 5,692,625 | A | 12/1997 | Filipescu | |
| 5,775,629 | A | 7/1998 | Cyr | |
| 6,325,324 | B1 | 12/2001 | Getz | |

FOREIGN PATENT DOCUMENTS

GB 2277509 * 11/1994

* cited by examiner

*Primary Examiner*—Evan H Langdon
(74) *Attorney, Agent, or Firm*—Robert Brouillette; Brouillette & Partners LLP

(57) ABSTRACT

An apparatus to package a plurality of tape spools that can be also used to unwind the tape spools.

27 Claims, 4 Drawing Sheets

TAPE DISPENSER/PACKAGE ASSEMBLY

BACKGROUND OF THE INVENTION

This invention relates to an improvement in an apparatus for dispensing a tape, i.e., ribbon, web or string, generally referred to herein as "tape", when the tape is being unwound at a laminating machine such as a corrugating machine or press. One aspect of the present invention is the unwinding of a roll of tape without having to individually unpack each roll or manipulate each roll of tape individually.

Reinforcing or Tear tapes have been used for many years in modem packaging as an aid to maintain structural integrity or as an easy open feature in boxes, packages and/or containers. The commercially available tape dispensers used at corrugating or laminating machine have an important limitation. All spools or rolls are supplied in individually packaged boxes, where each roll has to be unpacked, lifted and installed on a tape dispenser machine located near the corrugating or laminating machine. Since each roll has to be manually lifted and manipulated by the operators of the laminating or corrugating machine, each roll cannot weight more than 35 pounds to limit the dangers of injuries to the operators. This fact brings another important drawback. With a spool or roll weight this small, only a very limited amount of linear footage of tape can be wound on these rolls. With the laminating or corrugating machines going faster over the years, an important need for splicing these rolls arose, since these processes cannot be stopped as they need to have a constant supply of tape. In this industry the footage of these tape rolls are usually between 10,000 and 30,000 feet. Since multiple tapes are used in these packaging making processes, we often see a splicing rate for tape roll of 1 roll every 5 to 8 minutes. This means that an operator has to unpack a roll, lift it, install it on the dispenser and prepare the splicing mechanism every 5 to 8 minutes. This procedure can be very time consuming.

The literature is abundant with such tape dispensers and splicing systems, and they all have in common the limitation to roll size and weight and the necessity for the operator to manually handle these rolls. In more details, we can see U.S. Pat. Nos. 4,917,327 and 5,029,768 where we clearly see the general parameters of the tape dispenser and the need for tension control and a splicing mechanism. In U.S. Pat. Nos. 5,775,629 and 6,325,324 we also see different splicing techniques that can be used on tape dispensers.

The use of a package that dispenses tape exists in other applications than the corrugated board reinforcement or easy open feature for containers. For example, in the pressure sensitive adhesive packaging tape we can see many patents on this subject: U.S. Pat. Nos. 4,372,472; 4,453,634; 4,676,446; 4,998,655 and 5,071,051 are all patents on this subject. But all these patents, even if they cover the concept of package and dispenser, are all related to handheld dispenser of small rolls of pressure sensitive packaging tape and none use the concept of packaging/dispenser for the purpose of reducing roll manipulations and thus the increasing of tape roll footage.

Transport and packaging assemblies have also been proposed in the past. U.S. Pat. Nos. 5,228,821; 5,692,625 for example, disclosed folding racks for the storing and dispensing of rolled material. However, these systems are not design for high speed dispensing and they do not include tensioning/braking device to generate tension in the unwound material. Also, these systems are limited to one or two rolls, a feature which may not be desirable when multiple rolls are needed simultaneously.

OBJECT OF THE INVENTION

There is thus a need for a tape dispenser/package assembly that can hold multiple larger spools of tape.

An object of the present invention is to provide a tape dispenser/package that can be used both as a transport package for the rolls and as dispenser of the same rolls.

Another object of the present invention is to provide a tape dispenser/package that requires less human manipulation.

Yet another object of the present invention is to provide a tape dispenser/package that can hold multiple spools of tape which can be unwound simultaneously.

A further object of the present invention is to provide a tape dispenser/package that can be easily displaced around warehouse, factory and the like.

Yet another object of the present invention is to provide a tape dispenser/package that can be mounted on standard wooden or plastic pallet.

Another object of the present invention is to provide a tape dispenser/package that is cheap to manufacture.

Other objects of the present invention not described herein shall become apparent to one skilled in the art when using the tape dispenser/package assembly.

SUMMARY OF THE INVENTION

The present invention is directed to an apparatus providing the integration of the tape roll and the tape dispenser in a packaging system that almost totally eliminate the need for operator manipulation and reduce the occurrences of splicing of tape rolls. The tape is supplied in a dispenser/package assembly where it can be directly dispensed from. With this innovation, the operator does not have to manually lift individual roll to install it on a tape dispenser, and so the roll can be made much larger than what is currently available. For example, with this invention, a tape roll can be made to contain 3 to 5 times the linear footage of the tape rolls currently available. By increasing the size of the tape roll, we naturally reduce the amount of splicing from one roll to the next that has to be done at the corrugating machine or press.

The tape dispenser/package assembly comprises a base, a roll support structure and a tensioning/braking system. The base is preferably made out of a standard wooden pallet, the kind which is extensively used in the transport industries. This standard pallet base allows the dispenser/package assembly to be easily transported and/or displaced using a fork lift or a pallet jack. Moreover, since the dispenser/package assembly effectively acts both as a tape dispenser and as a tape rolls package, the dispenser/package assembly can be unloaded from a transport truck and be directly placed inside the factory in a single operation. It is to be understood that other types of pallets could be used without departing from the scope of the invention.

The tape rolls in the dispenser/package assembly are supported by the roll support structure. This structure is preferably made of wood but other materials such as metal could be used. The structure comprises two opposing parallel walls extending upwardly and perpendicularly from the base pallet. The two walls upper edges are linked together via reinforcing wooden or metal members. The walls are also preferably linked to the base pallet with angular reinforcing wooden or metal members. Each wall comprises a series of shaft holes facing each other into which the metal shafts holding the tape rolls are inserted. Preferably, there are four shaft holes in each wall and they are preferably located such that they form the corners of a trapezoid. This trapezoid feature allows for the simultaneous dispensing of tape from both the upper rolls and the lower rolls without entanglement of the tapes. The shafts are inserted in these shaft holes and are fixedly secured via a locking means.

The rolls preferably used in the tape dispenser/package assembly comprise a hollow cardboard core unto which the tape is wound. A shaft holder, having two portions, is inserted at both ends of the core. The first portion has a diameter corresponding to the inner diameter of the cardboard core in order for the shaft holder to be snugly inserted in the core. The second portion has a diameter larger than the diameter of the first portion. This difference in diameter thus creates a shoulder preventing the shaft holder to be inserted too deeply in the core. The second portion also acts as a friction surface for the rolls tensioning/braking device. The shaft holder is preferably made of metal, but any other suitable material may be used.

Located on the walls are the rolls tensioning/braking device. The device comprises two metal strips, each having an end attached to the wall. Each strip is bent around the shaft holder, thus creating a "S" shape. On the inner side of the bent portions of the strip is fixedly attached friction material such as brake pad material. The other ends of each strip are connected together via a spring. The spring helps create a more even friction force between the shaft holder and the tensioning/braking device as the tape in unwound from the roll. In the case of an abrupt stop of the machine, the tensioning/braking device helps stopping the rolls.

Multiple tape rolls can be supplied in the same dispenser/package assembly, to permit the use of multiple tapes in the corrugating machine or press and to have extra rolls available for splicing. A frame rack is also used, such frame being supplied with pulleys to provide tape paths out of the dispenser/package assembly to the corrugating machine or press. The frame rack can provide tape paths for more than one dispenser/package assembly and also provide the ability to splice one tape roll to the next for continuous feeding of the tape or tapes to the corrugating machine or press where the rolls to be spliced can be in the same dispenser/package assembly or in different dispenser/package assemblies.

These and other novel features of the invention will be more fully described here in below.

BRIEF DESCRIPTION OF THE DRAWINGS

The present invention will be described with reference to the accompanying drawing wherein.

DETAILLED DESCRIPTION OF THE A PREFERRED EMBODIMENT

Figure 1:
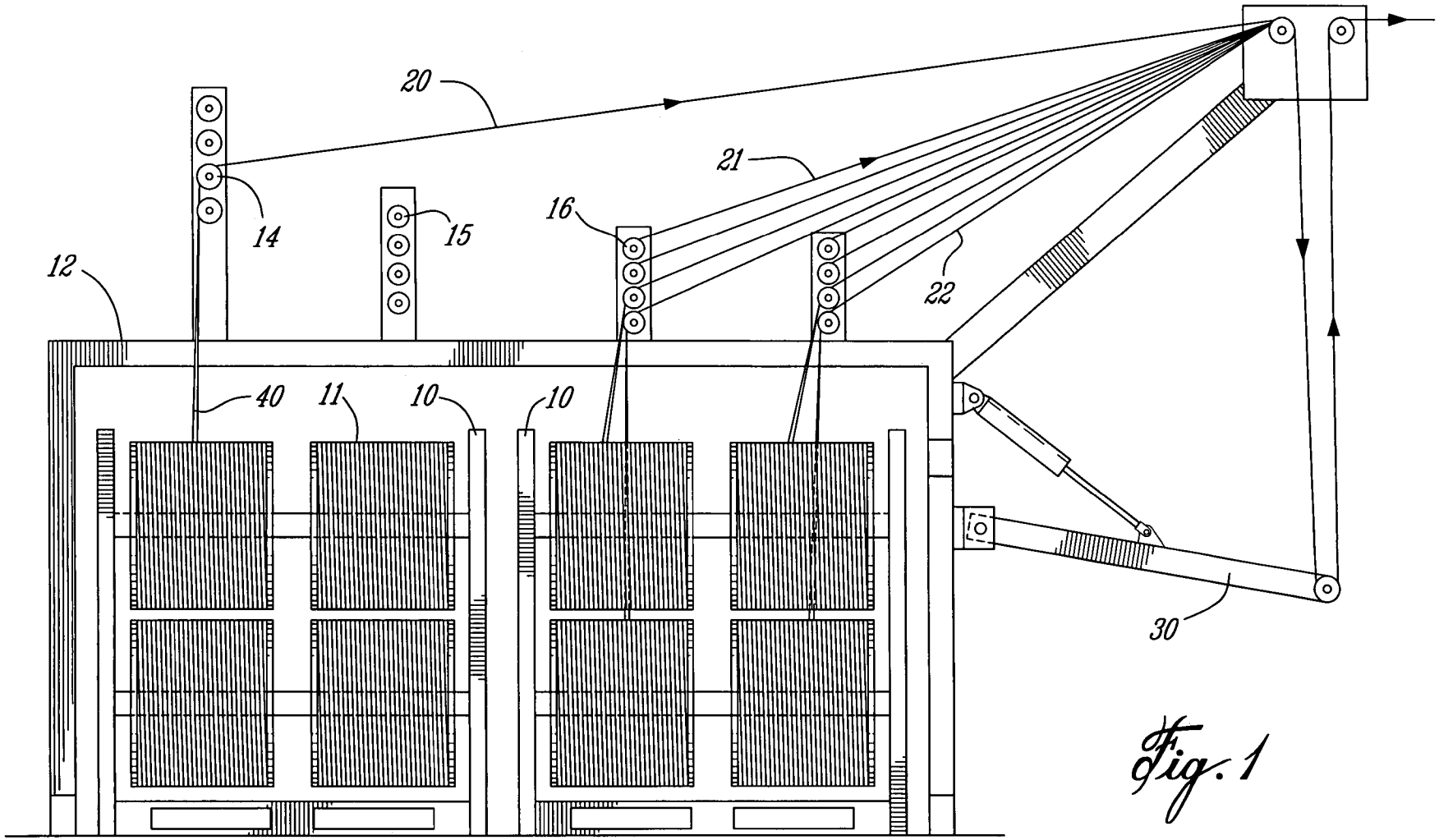
FIG. 1 is a front view of two dispenser/package assemblies with the frame rack over them providing the multiple tape paths.

The present invention provides an improved apparatus for the dispensing of a ribbon at the corrugating machine or press. The dispenser/package assembly 10 includes a frame rack 12 supporting guide rollers 14, 15, 16 to provide multiple tape paths 20, 21, 22 coming off the dispenser/package assembly up towards the splicer unit 30 and the corrugating machine or press. The tape 40 is pulled out from the dispenser/package assembly 10 and feed to the guide rollers 14, 15, 16 and the splicer unit 30. The tape roll 11 is inside the dispenser/package assembly 10 and the tape 40 can be unwound directly from the tape roll 11 without removing it from the dispenser/package assembly 10. To provide adequate tensioning of the tape 40 from start to end of the tape roll 11, a tensioning/braking device 31 is used to increase the friction against the shaft holder 32 which is inserted inside the core 17 of the tape roll 11 and running on the shaft 33.

Different splicing systems can be used in the splicer unit 30 of the frame rack 12 to splice on tape roll 11 to the next. Different tape paths 20, 21, 22 are provided to permit the splicing of any tape roll 11 with any other tape roll in the dispenser/package 10 or another dispenser/package positioned next to it.

The dispenser/package assembly 10 comprises a base 34. The base 34 is preferably a standard ISO (International Organization for Standardization) wooden pallet with openings 35 to be used by fork lift or pallet jack. A rolls support structure 36 is fixedly attached with screws, nails or the likes onto the base pallet 34. Support structure 36 comprises two opposing parallel walls 37. Walls 37 extend upwardly and perpendicularly from the base pallet. Walls 37 are linked together at their upper edges by reinforcing members 38. The reinforcing members 38 are parallel to the base pallet and are attached to the walls with screws, nails or the like. Angular reinforcing members 39 link the sides of the walls to the base pallet. The angular reinforcing members 39 are also attached with screws, nails or the like. The support structure 36 thus creates a box like shape. Located of the walls 37 are shaft holes 50. It is to be noted that each shaft hole 50 on a wall 37 has a correspondingly aligned shaft hole 50 in the opposing wall 37. Misalignment of two corresponding holes 50 would results in a misalignment of the shaft 33. Shaft holes 50 are located on the walls 37 as to form a trapezoid shape. The support structure 36 further comprises several parallel shafts 33 which are used to hold the tape rolls. The shafts 33 extend from one wall to the other and are slightly larger than the support structure 36. The protruding ends of the shafts 33 are used to lock the shafts in place using the locking means 51. There are thus two upper shafts 33 and two lower shafts 33.

Figure 2:
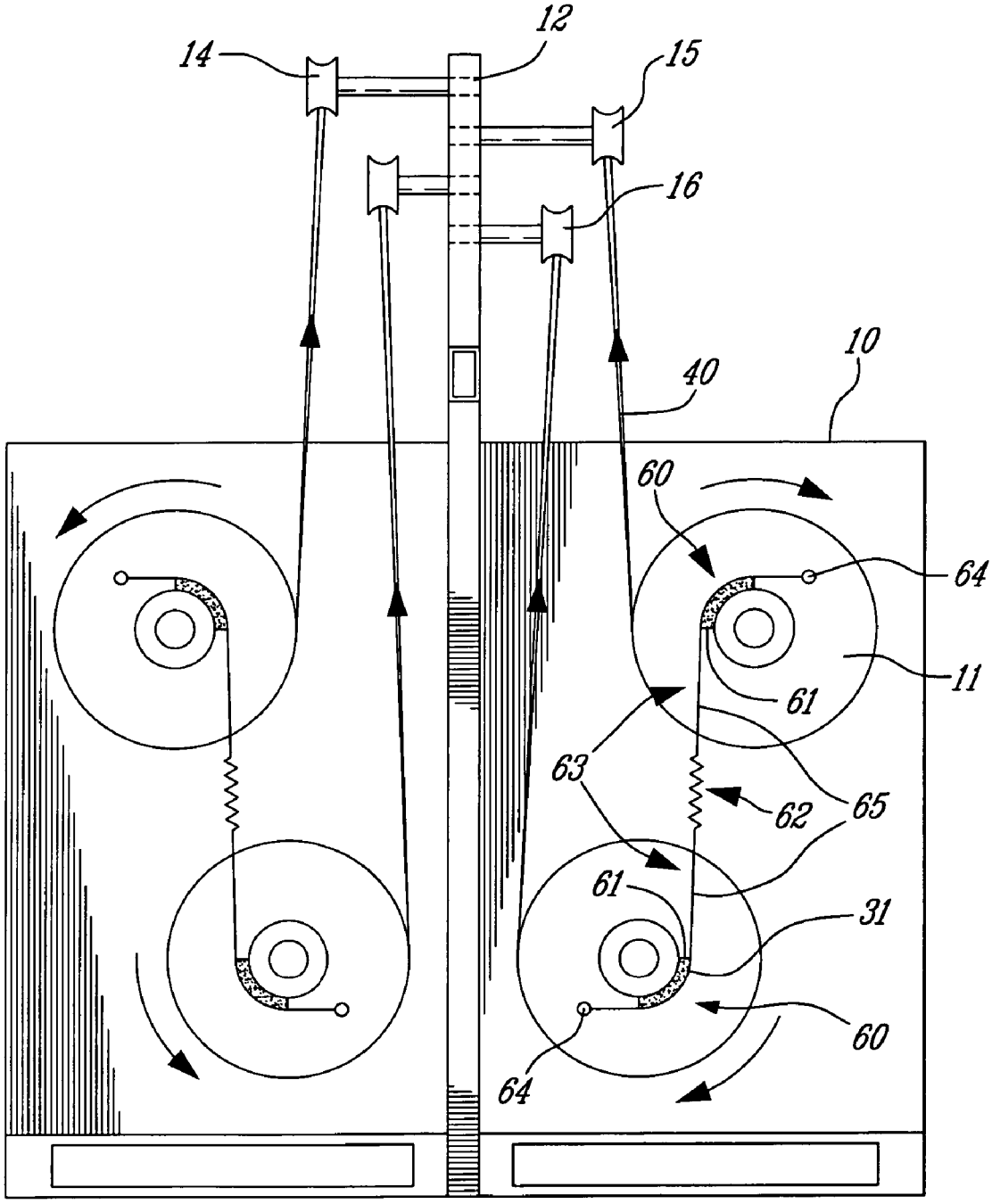
FIG. 2 is a side view of the dispenser/package assembly shown in FIG. 1 showing parts of the frame rack.
Figure 3:
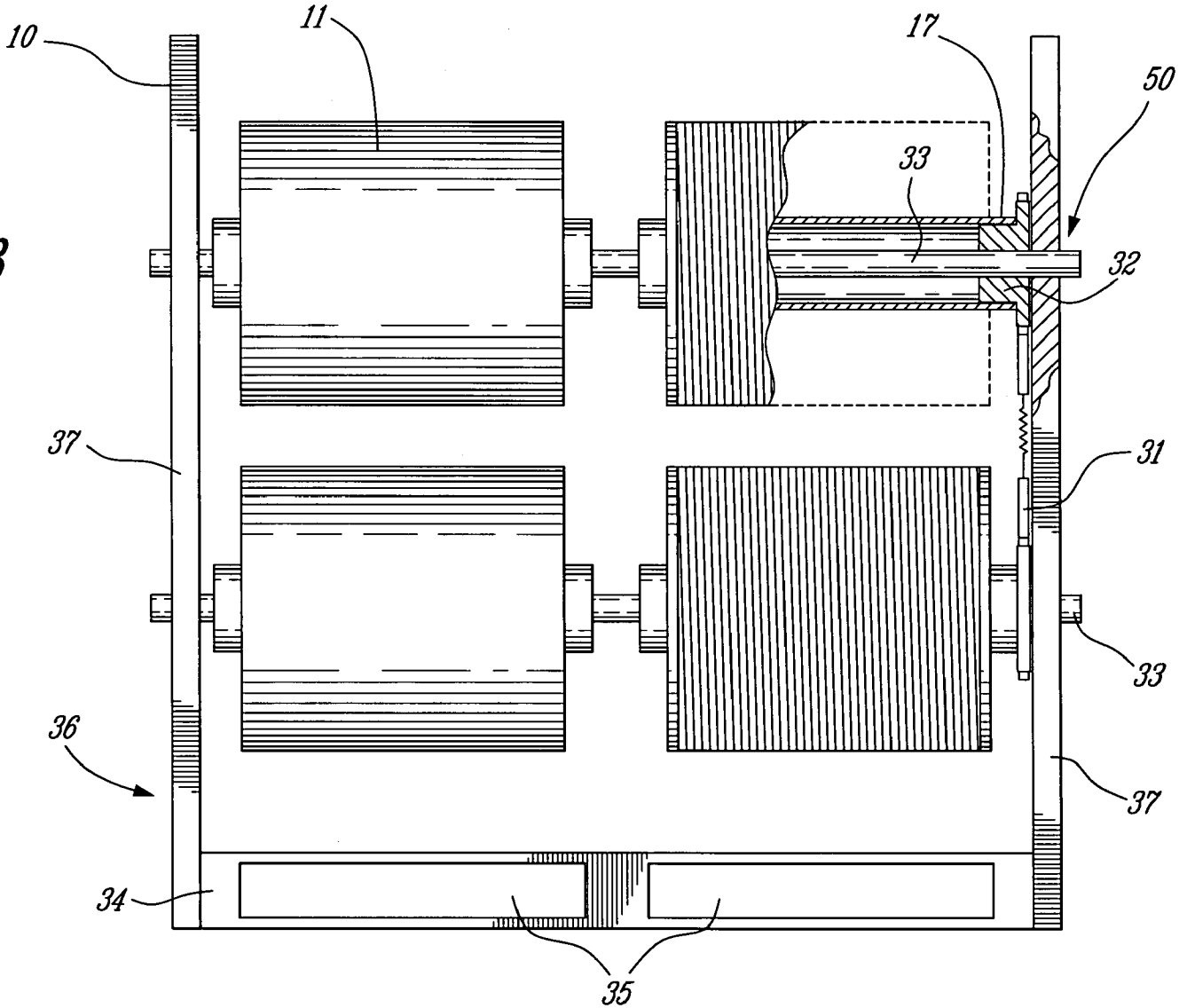
FIG. 3 is a front view of the dispenser/package assembly shown in FIG. 1 showing the shaft holder and the tensioning system.
Figure 4:
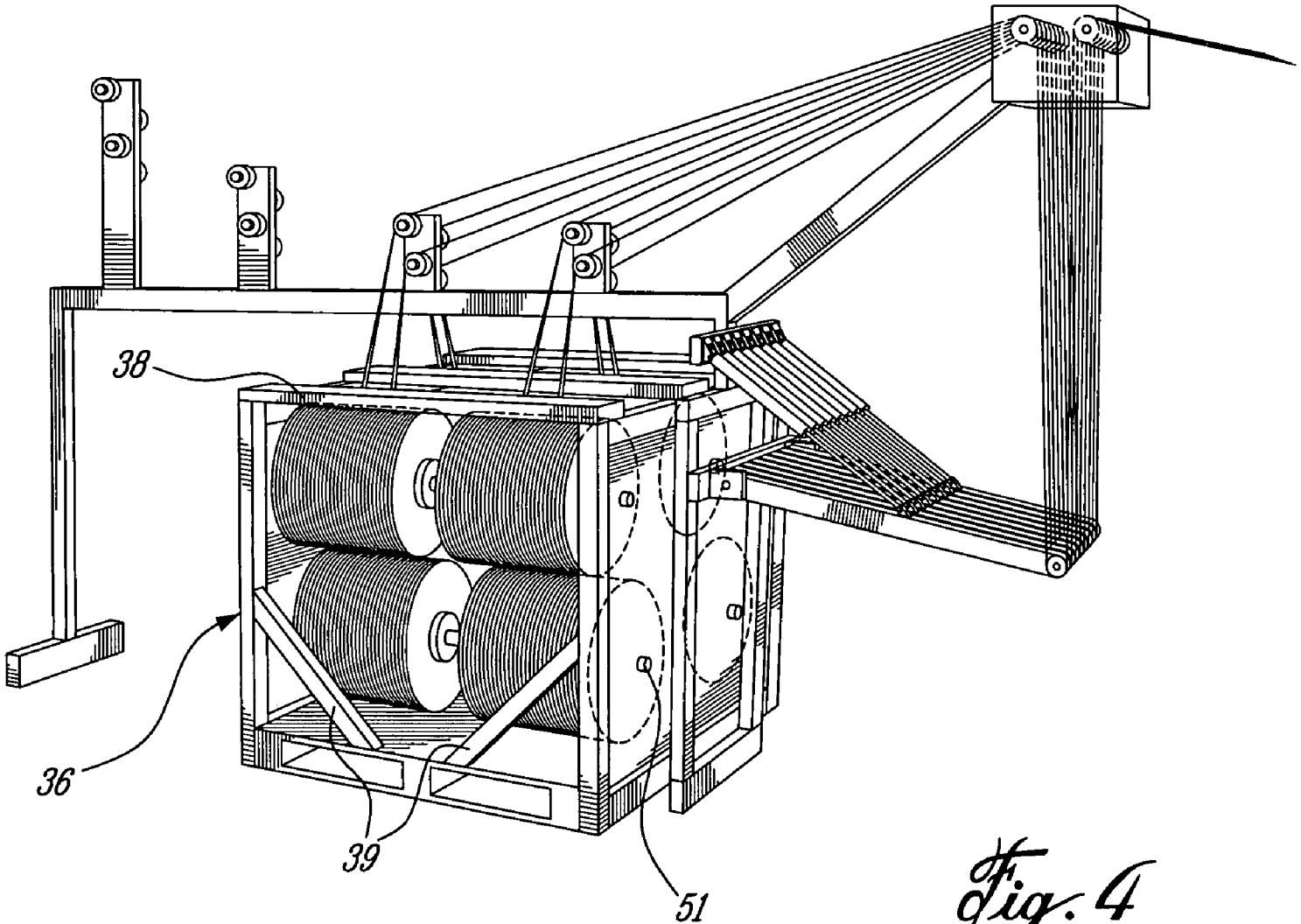
FIG. 4 is a perspective view of the dispenser/package assembly shown in FIG. 1 with the frame rack.

To increase the friction between shaft holder 32 and the shaft 33, a tensioning/braking device 31 is provided. Each tensioning/braking device 31 comprises a pair of metal strip 63 having each having an end 64. The ends 64 are fixedly attached to the wall 37. As shown in FIG. 2, each metal strip 63 is bent around the shaft holders, the two bent portions 60 thus creating an "S" shape metal strip. Friction material 61, such as brake padding, is attached in the inner side of the bent portions 60. It is this friction material 61 that increases the friction between shaft holder 32 and shaft 33. A spring 62 attaches the other end of each strip 63 together. The spring 62 is used to keep the friction between shaft holder 32 and shaft 33 relatively even as the tape 40 is unwound from the roll 11. Tensioning/braking device 31 acts like a brake when there is a sudden stop of the machine.

What is claimed is:

1. A dispenser/package assembly for rolls of tape, said dispenser/package assembly comprising:

a. a frame having a base, b. a first wall extending upwardly and perpendicularly from said base and having a first upper edge, c. a second, opposing wall extending upwardly and perpendicularly from said base and having a second upper edge, d. reinforcing members extending between said first and second upper edges and fixedly secured thereto, e. a plurality of shafts adapted to respectively receive at least one said roll, said shafts extending horizontally between said walls, f. at least one tensioning/braking device in contact with at least two of said rolls, said at least one tensioning/braking device comprising:

i. a first metal strip having a first extremity secured to one of said walls, a second extremity, and a first bent portion located therebetween and having first friction material disposed on the inner side thereof;

ii. a second metal strip having a third extremity secured to one of said walls, a fourth extremity, and a second bent portion located therebetween and having second friction material disposed on the inner side thereof, wherein said second and fourth extremities of said first and second metal strips are attached together with a spring and wherein said first and second friction materials are respectively in contact with said at least two rolls.

2. A dispenser/package assembly as claimed in claim 1, wherein said base is a wooden pallet.

3. A dispenser/package assembly as claimed in claim 1, wherein each of said shafts is adapted to receive a plurality of said rolls.

4. A dispenser/package assembly as claimed in claim 1, wherein there are four of said shafts.

5. A dispenser/package assembly as claimed in claim 1, wherein each of said shafts further comprises at least one shaft holder, each of said shaft holders being coaxially mounted on said shafts.

6. A dispenser/package assembly as claimed in claim 4, wherein each of said shafts supports one of said rolls.

7. A dispenser/package assembly as claimed in claim 4, wherein each of said shafts supports two of said rolls.

8. A dispenser/package assembly for rolls of tape, said dispenser/package assembly comprising:

a. a base;

b. a first wall extending upwardly from said base;

c. a second wall, opposite from said first wall, extending upwardly from said base;

d. a plurality of shafts adapted to respectively receive at least one of said rolls, said shafts extending substantially horizontally between said walls;

e. at least one tensioning/braking device in contact with at least one of said rolls, said at least tensioning/braking device comprising:

i. a first strip having a first extremity secured to one of said walls, a second extremity, and a first bent portion located therebetween and having first friction material disposed on the inner side thereof, said first friction material being in contact with one of said rolls;

ii. a second strip having a third extremity, a fourth extremity and a second bent portion located therebetween and having second friction material disposed on the inner side thereof, said second friction material being in contact with another one of said rolls;

iii. means for resiliently connecting said second extremity of said first strip and said fourth extremity of said second strip.

9. A dispenser/package assembly as claimed in claim 8, wherein said resilient means is a spring.

10. A dispenser/package assembly as claimed in claim 8, wherein said base is a wooden pallet.

11. A dispenser/package assembly as claimed in claim 8, wherein said base is a standard ISO (International Organization for Standardization) wooden pallet.

12. A dispenser/package assembly as claimed in claim 8, wherein each of said shafts is adapted to receive a plurality of rolls.

13. A dispenser/package assembly as claimed in claim 8, wherein there are four of said shafts.

14. A dispenser/package assembly as claimed in claim 8, wherein each of said shafts further comprises at least one shaft holder, each of said shaft holders being respectively coaxially mounted on said shafts.

15. A dispenser/package assembly as claimed in claim 13, wherein each of said shafts supports one of said rolls.

16. A dispenser/package assembly as claimed in claim 13, wherein each of said shafts supports two of said rolls.

17. A dispenser/package assembly as claimed in claim 8, wherein each of said shafts supports two of said rolls.

18. A dispenser/package assembly for rolls of tape, said dispenser/package assembly comprising:

a. abase;

b. a first wall extending upwardly from said base;

c. a second wall, opposite from said first wall, extending upwardly from said base;

d. a plurality of shafts adapted to respectively receive at least one of said rolls, said shafts extending substantially horizontally between said walls;

e. a plurality of tensioning/braking devices adapted to be in contact with a respective one of said rolls, each of said tensioning/braking devices comprising a strip having a first extremity secured to one of said walls, a second extremity, and a first bent portion located therebetween and having friction material disposed on the inner side thereof, said friction material being in contact with said respective one of said rolls;

wherein said tensioning/braking devices are paired and wherein each of said pairs further comprises means for resiliently connecting said second extremities of said strips of said tensioning/braking devices.

19. A dispenser/package assembly as claimed in claim 18, wherein said resilient means are springs.

20. A dispenser/package assembly as claimed in claim 18, wherein said base is a wooden pallet.

21. A dispenser/package assembly as claimed in claim 18, wherein said base is a standard ISO (International Organization for Standardization) wooden pallet.

22. A dispenser/package assembly as claimed in claim 18, wherein each of said shafts is adapted to receive a plurality of rolls.

23. A dispenser/package assembly as claimed in claim 18, wherein there are four of said shafts.

24. A dispenser/package assembly as claimed in claim 18, wherein each of said shafts further comprises at least one shaft holder, each of said shaft holders being respectively coaxially mounted on said shafts.

25. A dispenser/package assembly as claimed in claim 23, wherein each of said shafts supports one of said rolls.

26. A dispenser/package assembly as claimed in claim 23, wherein each of said shafts supports two of said rolls.

27. A dispenser/package assembly as claimed in claim 18, wherein each of said shafts supports two of said rolls.

* * * * *